US008552914B2

(12) United States Patent
Xie

(10) Patent No.: US 8,552,914 B2
(45) Date of Patent: Oct. 8, 2013

(54) ANTENNA AND ANTENNA ASSEMBLY USING SAME

(75) Inventor: Jia-Jun Xie, Shenzhen (CN)

(73) Assignees: AAC Acoustic Technologies (Shenzhen) Co., Ltd., Shenzhen (CN); American Audio Components Inc., La Verne, CA (US)

( * ) Notice: Subject to any disclaimer, the term of this patent is extended or adjusted under 35 U.S.C. 154(b) by 364 days.

(21) Appl. No.: 13/015,903

(22) Filed: Jan. 28, 2011

(65) Prior Publication Data

US 2011/0260938 A1 Oct. 27, 2011

(30) Foreign Application Priority Data

Apr. 27, 2010 (CN) ..... 2010 2 0178660 U

(51) Int. Cl.
*H01Q 1/24* (2006.01)

(52) U.S. Cl.
USPC ..... 343/702; 343/700 MS

(58) Field of Classification Search
USPC ..... 343/702, 700 MS
See application file for complete search history.

(56) References Cited

U.S. PATENT DOCUMENTS

| | | | | |
|---|---|---|---|---|
| 6,239,753 | B1 * | 5/2001 | Kado et al. | 343/702 |
| 7,271,770 | B2 * | 9/2007 | Washiro | 343/702 |
| 7,372,406 | B2 * | 5/2008 | Shiotsu et al. | 343/700 MS |
| 8,077,116 | B2 * | 12/2011 | Shamblin et al. | 343/895 |

* cited by examiner

*Primary Examiner* — Hoanganh Le
(74) *Attorney, Agent, or Firm* — IPro, Inc.; Na Xu

(57) ABSTRACT

The present invention provides an antenna for transmitting/receiving a first frequency signal and a second frequency signal. The antenna includes a first frequency antenna branch for transmitting/receiving the first frequency signal, a second frequency antenna branch separated from the first frequency antenna branch for transmitting/receiving the second frequency signal and an inductance for connecting the first and second frequency antenna branches in series with one another. The inductance is capable of preventing the first frequency signal passing through the second frequency antenna branch.

12 Claims, 3 Drawing Sheets

ANTENNA AND ANTENNA ASSEMBLY USING SAME

FIELD OF THE INVENTION

The present invention relates to an antenna for transmitting/receiving dual frequency signals.

DESCRIPTION OF RELATED ART

A planar antenna assembly related to the present invention for transmitting/receiving low frequency signals and high frequency signals includes a substrate and a planar antenna extending from one rim of the substrate. The planar antenna comprises a connecting patch, a feed strip extending from one end of the connecting patch for coupling to the substrate, a low-frequency antenna branch and a high-frequency antenna branch extending from another end of the connecting patch, respectively.

The two antenna branches are connected in parallel with each other and have considerably extended antenna surfaces in each case, so that the planar antenna requires much more space overall.

So, it is necessary to provide a new means for solving the problem mentioned above.

DETAILED DESCRIPTION OF THE EXEMPLARY EMBODIMENTS

Reference will now be made to describe the exemplary embodiments of the present invention in detail.

Figure 1:
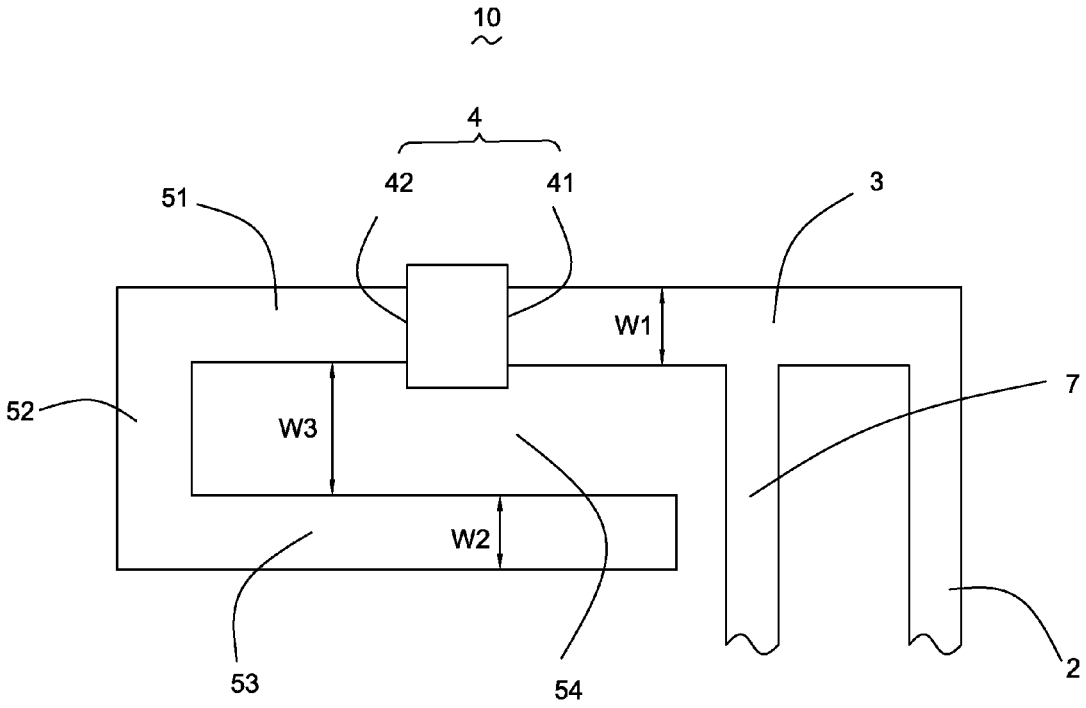
FIG. 1 is a plan view of an antenna of an embodiment of the present invention.
Figure 2:
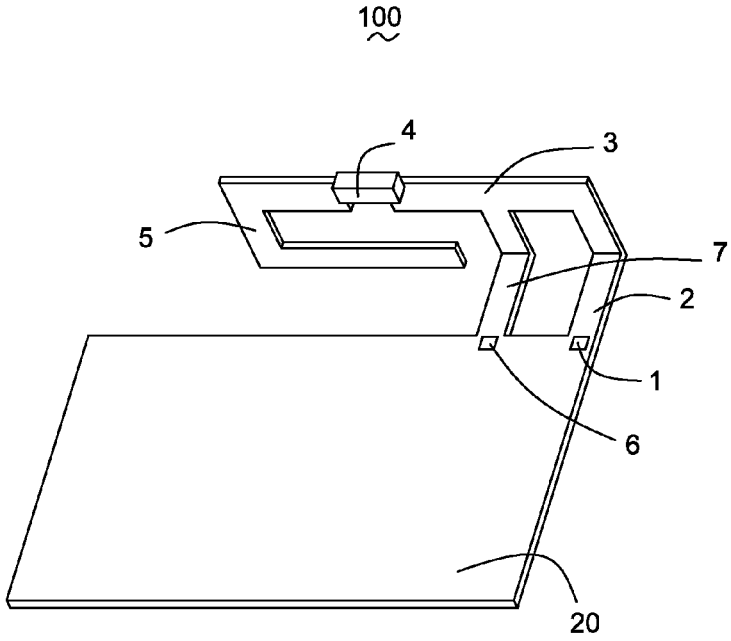
FIG. 2 is an illustrative view of an antenna assembly according to a first exemplary embodiment of the present invention using the antenna in FIG. 1.

Referring to FIGS. 1 and 2, the invention relates to an antenna assembly 100 for transmitting/receiving low frequency signals and high frequency signals comprises a substrate 20 and an antenna 10 extending from one rim of the substrate 20. The substrate 20 defines a feed point 1 and a ground point 6 separated from the feed point 1. The antenna 10 defines a low-frequency antenna branch 5 for transmitting/receiving low frequency signals, a high-frequency antenna branch 3 separated from the low-frequency antenna branch 5 for transmitting/receiving high frequency signals, an inductance 4 for connecting the low-frequency and high-frequency antenna branches in series with one another, a feed strip 2 extending downwardly from one rim of a high-frequency antenna branch 3 toward the substrate 20 for coupling to the feed point 1 of the substrate 20, and a ground strip 7 extending downwardly from the same rim of a high-frequency antenna branch 3 toward the substrate 20 for coupling to the ground point 6 of the substrate 20. The inductance 4 is capable of preventing the high-frequency signal through the low-frequency antenna branch 5. The feed strip 2 is separated from the ground strip 7 and parallel to the ground strip 7.

The high-frequency antenna branch 3, perpendicular to the substrate 20, is configured to be a plate and defines a first width W1 which remains essentially constant over a length of the high-frequency antenna branch 3.

The low-frequency antenna branch 5, perpendicular to the substrate 20, is U-shaped and defines a first portion 51, a second portion 52 extending downwardly from the free end of the first portion 51, a third portion 53 extending perpendicularly from the free end of the second portion 52 towards the low-frequency antenna branch 5 and unconnected to the feed and ground strips 2 and 7, and a gap 54 between the first and third portions 51 and 53. The second portion 52 is at an angle of 90 degrees with the first portion 51 and the third portion 53 is again at an angle of 90 degrees with the second portion 52.

The inductance 4 defines a first end 41 for connecting to the high-frequency antenna branch 3 and a second end 42 for connecting to the first portion 51 of the low-frequency antenna branch 5.

A respective overall length of the portions 51, 52 and 53 is different from one another. The length of the third portion 53 is longer than that of the first portion 51. In alternative embodiments, the first, second and third portions have the same length.

The third portion 53 of the low frequency antenna branch 5 defines a second width W2 which remains essentially constant over the lengths thereof. In alternative embodiments, this width is irregular.

The gap 54 defines a third width W3. The first and third portions 51 and 53 are approximately alongside each other and parallel to each other, so that the third width W3 of the gap 54 remains essentially constant over the lengths of the third portion 53.

A respective outline of the portions 51, 52 and 53 is configured to be a rectangle, so that the shape of the gap 54 is regular. In alternative embodiments, these outlines are comparatively irregular and the shape of the gap is very irregular.

Figure 3:
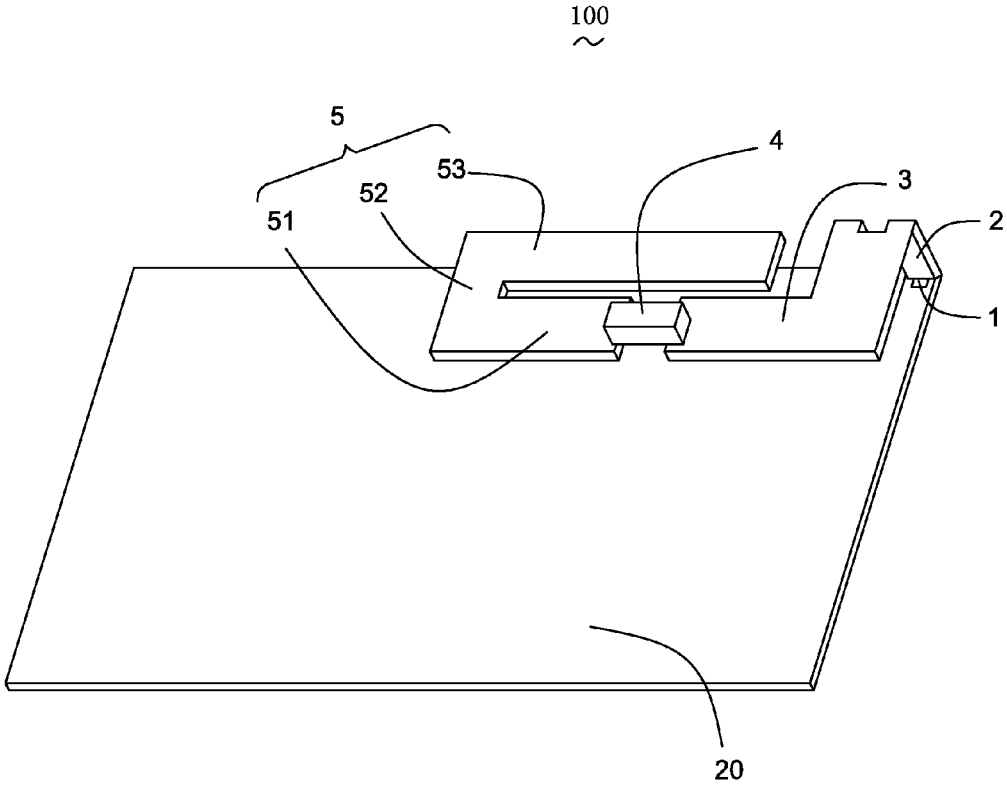
FIG. 3 is an illustrative view of an antenna assembly according to a second exemplary embodiment of the present invention using the antenna in FIG. 1.

FIG. 3 illustrates an antenna assembly in accordance with a second embodiment of the present invention.

The low-frequency and high-frequency antenna branches 3 and 5 are parallel to the substrate 20, respectively. Therefore, the high-frequency antenna branch 3 is generally L-shaped and the second portion 52 of the low-frequency antenna branch 5 extends substantially perpendicularly from the free end of the first portion 51.

The low-frequency and high-frequency antenna branches are connected in series with each other, so that the overall volume of the planar antenna becomes smaller.

While the present invention has been described with reference to the specific embodiments, the description of the invention is illustrative and is not to be construed as limiting the invention. Various of modifications to the present invention can be made to the exemplary embodiments by those skilled in the art without departing from the true spirit and scope of the invention as defined by the appended claims.

What is claimed is:

1. An antenna for transmitting/receiving first frequency signals and second frequency signals comprising:

a first frequency antenna branch for transmitting/receiving the first frequency signals;

a second frequency antenna branch for transmitting/receiving the second frequency signals;

a feed strip extending downwardly from one end of the first frequency antenna branch and far away from the second frequency antenna branch for reducing the size of the antenna;

an inductance for connecting the first and second frequency antenna branches in series with one another; and wherein, the inductance is capable of preventing the first frequency signal passing through the second frequency antenna branch.

2. The antenna as described in claim 1, wherein the second frequency antenna branch defines a first portion, a second portion extending substantially perpendicularly from the free end of the first portion, a third portion extending substantially perpendicularly from the free end of the second portion toward the first frequency antenna branch, and a gap between the first and third portions.

3. The antenna as described in claim 2, wherein the gap defines a third width which remains essentially constant over the lengths of the third portion of the second frequency antenna branch.

4. The antenna as described in claim 1, wherein the first frequency antenna branch defines a first width which remains essentially constant over the lengths thereof.

5. The antenna as described in claim 4, wherein the second frequency antenna branch defines a second width which remains essentially constant over the lengths thereof.

6. An antenna assembly for transmitting/receiving first frequency signals and second frequency signals comprising:

a substrate defining a feed point;

a first frequency antenna branch parallel to the substrate for transmitting / receiving the first frequency signal;

a second frequency antenna branch parallel to the substrate for transmitting / receiving the second frequency signal;

an inductance for connecting the first and second antenna branches in series with one another; and a feed strip extending downwardly from one end of a first frequency antenna branch toward the substrate and far away from the second frequency antenna branch for coupling to the feed point of the substrate;

wherein, the inductance is capable of preventing the first frequency signal passing through the second frequency antenna branch.

7. The antenna assembly as described in claim 6, wherein the substrate further defines a ground point separated from the feed point and the antenna assembly further defines a ground strip extending downwardly from the same rim of a first frequency antenna branch and separated from the feed strip for coupling to the ground point of the substrate.

8. The antenna as described in claim 7, wherein the feed strip is parallel to the ground strip.

9. The antenna as described in claim 7, wherein the second frequency antenna branch defines a first portion, a second portion extending bendly from the free end of the first portion, a third portion extending bendly from the free end of the second portion towards the first frequency antenna branch and unconnected to the feed and ground strips, and a gap between the first and third portions.

10. The antenna as described in claim 9, wherein the first, second and third portions have rectangular shape.

11. An antenna assembly for transmitting / receiving first frequency signals and second frequency signals comprising:

a substrate defining a feed point;

a first frequency antenna branch perpendicular to the substrate for transmitting / receiving the first frequency signals;

a second frequency antenna branch perpendicular to the substrate and separated from the first frequency antenna branch for transmitting / receiving the second frequency signals;

an inductance for connecting the first and second antenna branches in series with one another; and a feed strip extending downwardly from one end of a first frequency antenna branch toward the substrate for coupling to the feed point of the substrate;

wherein, the inductance is capable of preventing the first frequency signal passing through the second frequency antenna branch.

12. The antenna assembly as described in claim 11, wherein the second frequency antenna branch defines a first portion, a second portion extending downwardly from the free end of the first portion, a third portion extending from the free end of the second portion towards the first frequency antenna branch and unconnected to the feed strip, and a gap between the first and third portions.

* * * * *